US009236172B2

(12) United States Patent
Lee et al.

(10) Patent No.: US 9,236,172 B2
(45) Date of Patent: Jan. 12, 2016

(54) CONDUCTOR PATTERN AND COIL PARTS HAVING THE SAME

(75) Inventors: Sang Moon Lee, Seoul (KR); Yong Suk Kim, Gyeonggi-do (KR); Jeong Bok Kwak, Gyeonggi-do (KR); Young Seuck Yoo, Seoul (KR); Sung Kwon Wi, Seoul (KR)

(73) Assignee: Samsung Electro-Mechanics Co., Ltd., Suwon-Si, Gyeonggi-Do (KR)

( * ) Notice: Subject to any disclaimer, the term of this patent is extended or adjusted under 35 U.S.C. 154(b) by 174 days.

(21) Appl. No.: 13/420,540

(22) Filed: Mar. 14, 2012

(65) Prior Publication Data

US 2013/0141205 A1 Jun. 6, 2013

(30) Foreign Application Priority Data

Dec. 6, 2011 (KR) ..... 10-2011-0129842

(51) Int. Cl.
*H01F 5/00* (2006.01)
*H01F 27/28* (2006.01)

(52) U.S. Cl.
CPC ..... *H01F 5/003* (2013.01)

(58) Field of Classification Search
USPC ..... 336/200, 232
See application file for complete search history.

(56) References Cited

U.S. PATENT DOCUMENTS

| | | | | |
|---|---|---|---|---|
| 6,356,181 | B1 * | 3/2002 | Kitamura | 336/200 |
| 6,559,560 | B1 * | 5/2003 | Jin et al. | 307/104 |
| 7,307,503 | B2 * | 12/2007 | Kaji et al. | 336/200 |
| 2009/0160018 | A1 * | 6/2009 | Nabeshima et al. | 257/531 |

FOREIGN PATENT DOCUMENTS

| | | | |
|---|---|---|---|
| JP | 05135968 | A * | 6/1993 |
| JP | 2006261585 | A * | 9/2006 |
| JP | 2009-010137 | A | 1/2009 |
| JP | 2011018756 | A * | 1/2011 |
| KR | 10-2002-0007220 | A | 1/2002 |

* cited by examiner

*Primary Examiner* — Tsz Chan
(74) *Attorney, Agent, or Firm* — McDermott Will & Emery LLP

(57) ABSTRACT

A conductor pattern of a coil part formed in a spiral shape on a magnetic substrate, which includes: a primary conductor pattern; and a secondary conductor pattern formed on the primary conductor pattern. The primary conductor pattern is formed to have a longitudinal section including a first horizontal portion and a first vertical portion electrically connected to an end portion of one surface of the first horizontal portion. The secondary conductor pattern is formed to have a longitudinal section including a second horizontal portion corresponding to the first horizontal portion and a second vertical portion electrically connected to an end portion of one surface of the second horizontal portion.

4 Claims, 5 Drawing Sheets

- PRIOR ART -

CONDUCTOR PATTERN AND COIL PARTS HAVING THE SAME

CROSS-REFERENCE TO RELATED APPLICATIONS

Claim and incorporate by reference domestic priority application and foreign priority application as follows:

"Cross Reference to Related Application

This application claims the benefit under 35 U.S.C. Section 119 of Korean Patent Application Serial No. 10-2011-0129842, entitled filed Dec. 6, 2011, which is hereby incorporated by reference in its entirety into this application."

BACKGROUND OF THE INVENTION

1. Field of the Invention

The present invention relates to a conductor pattern and coil parts having the same, and more particularly, to a conductor pattern and coil parts having the same that are capable of achieving miniaturization by reducing a horizontal size of a coil part compared to the same size of a conductor pattern and implementing high performance and characteristics by increasing a cross section of the conductor pattern compared to the same size of the conductor pattern to obtain high inductance.

2. Description of the Related Art

Electronic products, such as digital TVs, smart phones, and notebook computers, have functions for data communication in radio-frequency bands. Such IT electronic products are expected to be more widely used since they have multifunctional and complex features by connecting not only one device but also USBs and other communication ports.

Here, for higher-speed data communication, data are communicated through more internal signal lines by moving from MHz frequency bands to GHz radio-frequency bands.

When more data are communicated between a main device and a peripheral device over a GHz radio-frequency band, it is difficult to provide smooth data processing due to a signal delay and other noises.

In order to solve the above problem, an EMI prevention part is provided around the connection between an IT device and a peripheral device. However, conventional EMI prevention parts are used only in limited regions such as specific portions and large-area substrates since they are coil-type and stack-type and have large chip part sizes and poor electrical characteristics. Therefore, there is a need for EMI prevention parts that are suitable for slim, miniaturized, complex, and multifunctional features of electronic products.

A common-mode filter of EMI prevention coil parts in accordance with the prior art is described below in detail with reference to FIG. 1.

Referring to FIGS. 1 to 2*c*, a conventional common-mode filter includes a lower magnetic substrate 10, an insulating layer 20 disposed on the lower magnetic substrate 10 and including a first coil pattern 21 and a second coil pattern 22 which are vertically symmetrical to each other, and an upper magnetic body 30 disposed on the insulating layer 20.

Here, the insulating layer 20 including the first coil pattern 21 and the second coil pattern 22 is formed on the lower magnetic substrate 10 through a thin-film process. An example of the thin-film process is disclosed in Japanese Patent Application Laid-Open No. 8-203737.

And, a first input lead pattern 21*a* and a first output lead pattern 21*b* for inputting and outputting electricity to and from the first coil pattern 21 are formed on the insulating layer 20. A second input lead pattern 22*a* and a second output lead pattern 22*b* for inputting and outputting electricity to and from the second coil pattern 22 are formed on the insulating layer 20.

In more detail, the insulating layer 20 consists of a first coil layer including the first coil pattern 21 and the first input lead pattern 21*a*, a second coil layer including the second coil pattern 22 and the second input lead pattern 22*a*, and a third coil layer including the first output lead pattern 21*b* and the second output lead pattern 22*b*.

That is, the first coil layer is formed by coating an insulating material after forming the first coil pattern 21 and the first input lead pattern 21*a* on an upper surface of the lower magnetic substrate 10 through a thin-film process.

And, the second coil layer is formed by coating an insulating material after forming the second coil pattern 22 corresponding to the first coil pattern 21 and the second input lead pattern 22*a* on an upper surface of the first coil layer through a thin-film process.

Next, the third coil layer is formed by coating an insulating material after forming the first output lead pattern 21*b* and the second output lead pattern 22*b* on an upper surface of the second coil layer through a thin-film process for external output of the first coil pattern 21 and the second coil pattern 22.

At this time, the first coil pattern 21 and the second coil pattern 22 may be electrically connected to the first output lead pattern 21*b* and the second output lead pattern 22*b* through via connection structures, respectively.

Meanwhile, the first input lead pattern 21*a* is connected to a first external input terminal 41*a*, the first output lead pattern 21*b* is connected to a first external output terminal (not shown) corresponding to the first external input terminal 41*a*, the second input lead pattern 22*a* is connected to a second external input terminal 42*a*, and the second output lead pattern 22*b* is connected to a second external output terminal (not shown) corresponding to the second external input terminal 42*a*.

Although not shown in detail, the first coil layer to the third coil layer may be formed in a sheet shape and combined in a stack-type to form the above-described insulating layer including the first and second coil patterns, the first and second input lead patterns, and the first and second output lead patterns.

However, in the conventional common-mode filter configured as above, in order to improve performance and capacity, lengths of the first coil pattern 21 and the second coil pattern 22 are increased. In this case, even though the performance and capacity of the product are improved according to an increase in the cross section of the first coil pattern 21 and the second coil pattern 22, an increase in the size of the product is caused by an increase in the horizontal size, that is, left and right size of the product, and manufacturing costs are increased due to an increase in the size of components other than the first coil pattern 21 and the second coil pattern 22.

Accordingly, the conventional common-mode filter has limits and restrictions in improving the performance and capacity of the product due to problems occurring when improving performance and capacity.

SUMMARY OF THE INVENTION

The present invention has been invented in order to overcome the above-described problems and it is, therefore, an object of the present invention to provide a conductor pattern and coil parts having the same that are capable of achieving miniaturization by reducing a horizontal size of a coil part compared to the same size of a conductor pattern.

It is another object of the present invention to provide a conductor pattern and coil parts having the same that are capable of implementing high performance and characteristics by increasing a cross section of a conductor pattern compared to the same size of the conductor pattern to obtain high inductance.

In accordance with one aspect of the present invention to achieve the object, there is provided a conductor pattern of a coil part formed in a spiral shape on a magnetic substrate including: a primary conductor pattern; and a secondary conductor pattern formed on the primary conductor pattern, wherein the primary conductor pattern is formed to have a longitudinal section including a first horizontal portion and a first vertical portion electrically connected to an end portion of one surface of the first horizontal portion, and the secondary conductor pattern is formed to have a longitudinal section including a second horizontal portion corresponding to the first horizontal portion and a second vertical portion electrically connected to an end portion of one surface of the second horizontal portion, which faces one surface of the first horizontal portion.

Here, the first vertical portion may be formed in an inner end portion of an upper surface of the first horizontal portion, and the second vertical portion may be formed in an outer end portion of a lower surface of the second horizontal portion.

And, a horizontal width of the first horizontal portion may be 10 to 15 μm, a vertical width of the first horizontal portion may be 3 to 5 μm, a horizontal width of the first vertical portion may be 3 to 5 μm, and a vertical width of the first vertical portion may be 12 to 15 μm.

At this time, the second horizontal portion and the second vertical portion may be formed with the same size as the first horizontal portion and the first vertical portion.

In accordance with another aspect of the present invention to achieve the object, there is provided a coil part including: a magnetic substrate; a primary conductor pattern formed in a spiral shape on the magnetic substrate; and a secondary conductor pattern formed in a spiral shape on the primary conductor pattern to correspond to the primary conductor pattern, wherein the primary conductor pattern is formed to have a longitudinal section including a first horizontal portion and a first vertical portion electrically connected to an end portion of one surface of the first horizontal portion, and the secondary conductor pattern is formed to have a longitudinal section including a second horizontal portion corresponding to the first horizontal portion and a second vertical portion electrically connected to an end portion of one surface of the second horizontal portion, which faces one surface of the first horizontal portion.

Here, the first vertical portion may be formed in an inner end portion of an upper surface of the first horizontal portion, and the second vertical portion may be formed in an outer end portion of a lower surface of the second horizontal portion.

Further, a horizontal width of the first horizontal portion may be 10 to 15 μm, a vertical width of the first horizontal portion may be 3 to 5 μm, a horizontal width of the first vertical portion may be 3 to 5 μm, and a vertical width of the first vertical portion may be 12 to 15 μm.

Of course, the second horizontal portion and the second vertical portion may be formed with the same size as the first horizontal portion and the first vertical portion.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which:

FIGS. 5*a* to 5*f* are process diagrams for explaining a process of manufacturing the conductor pattern in accordance with the present invention, wherein FIG. 5*a* is a cross-sectional view schematically showing a state in which a first horizontal portion of a primary conductor pattern is plated through a first mask by primary photo and exposure processes, FIG. 5*b* is a cross-sectional view schematically showing a state in which the first mask of FIG. 5*a* is removed, FIG. 5*c* is a cross-sectional view schematically showing a state in which a first vertical portion and a second vertical portion of a secondary conductor pattern are plated through a second mask by secondary photo and exposure processes, FIG. 5*d* is a cross-sectional view schematically showing a state in which the second mask of FIG. 5*c* is removed, FIG. 5*e* is a cross-sectional view schematically showing a state in which a second horizontal portion is plated through a third mask by tertiary photo and exposure processes, and FIG. 5*f* is a cross-sectional view schematically showing a state in which the conductor pattern including the primary conductor pattern and the secondary conductor pattern is formed by removing the third mask of FIG. 5*e*.

DETAILED DESCRIPTION OF THE PREFERABLE EMBODIMENTS

Figure 1:
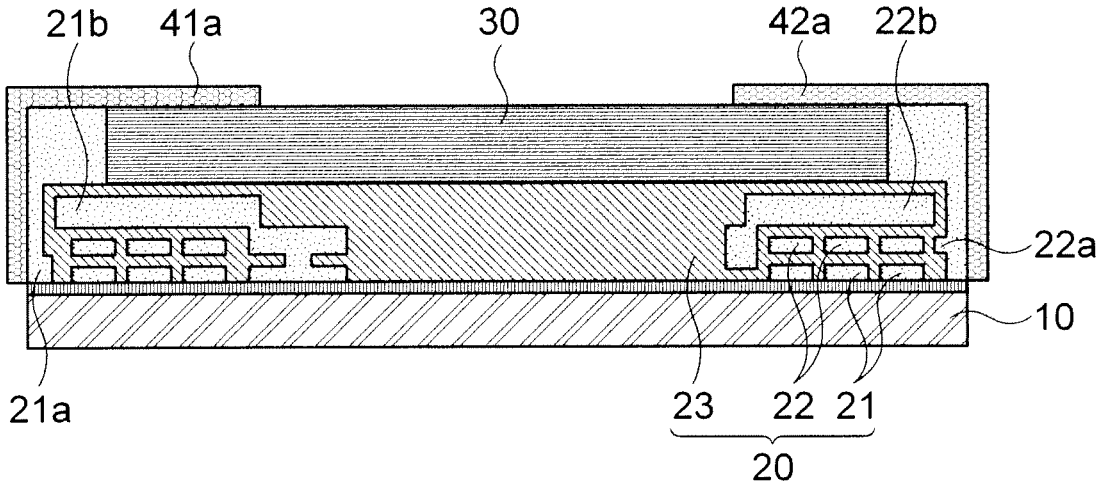
FIG. 1 is a cross-sectional view schematically showing a common-mode filter of conventional coil parts.
Figure 2A:
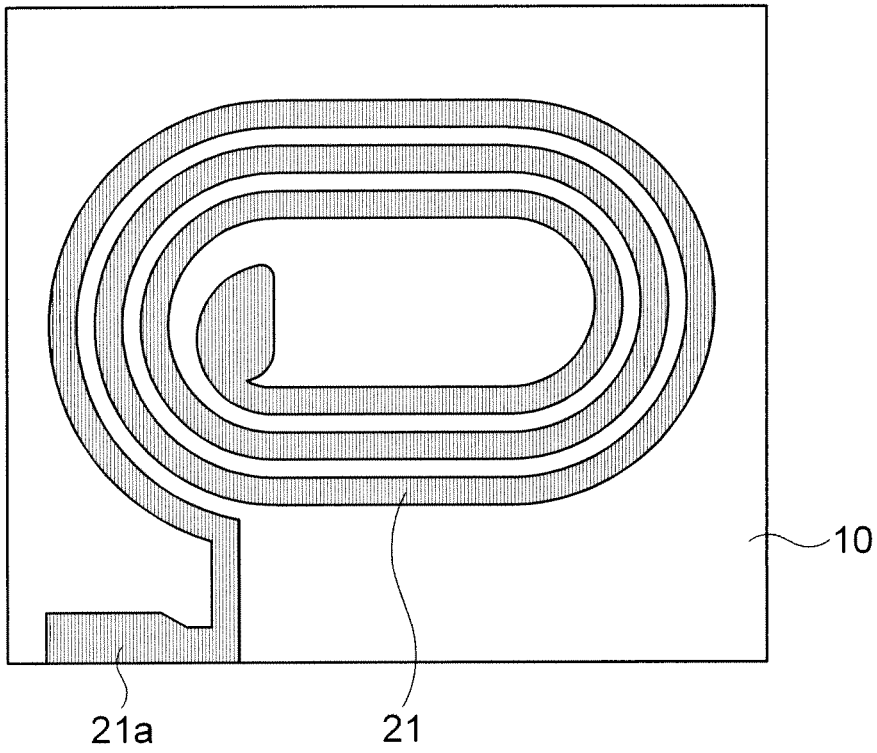
FIG. 2*a* is a plan view schematically showing a primary coil pattern of FIG. 1.
Figure 2B:
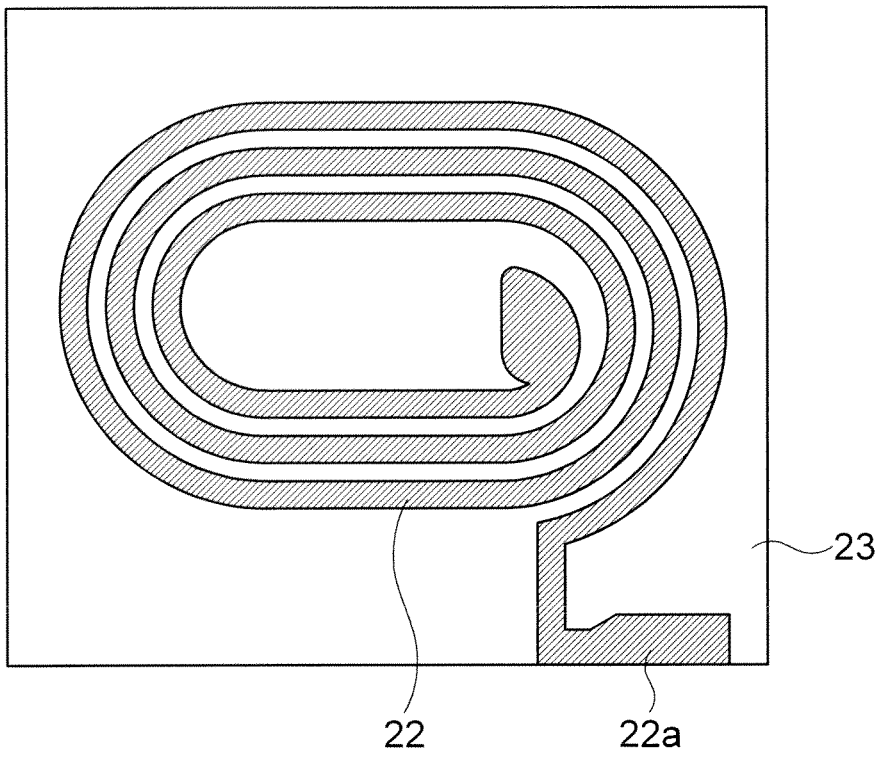
FIG. 2*b* is a plan view schematically showing a secondary coil pattern of FIG. 1.
Figure 2C:
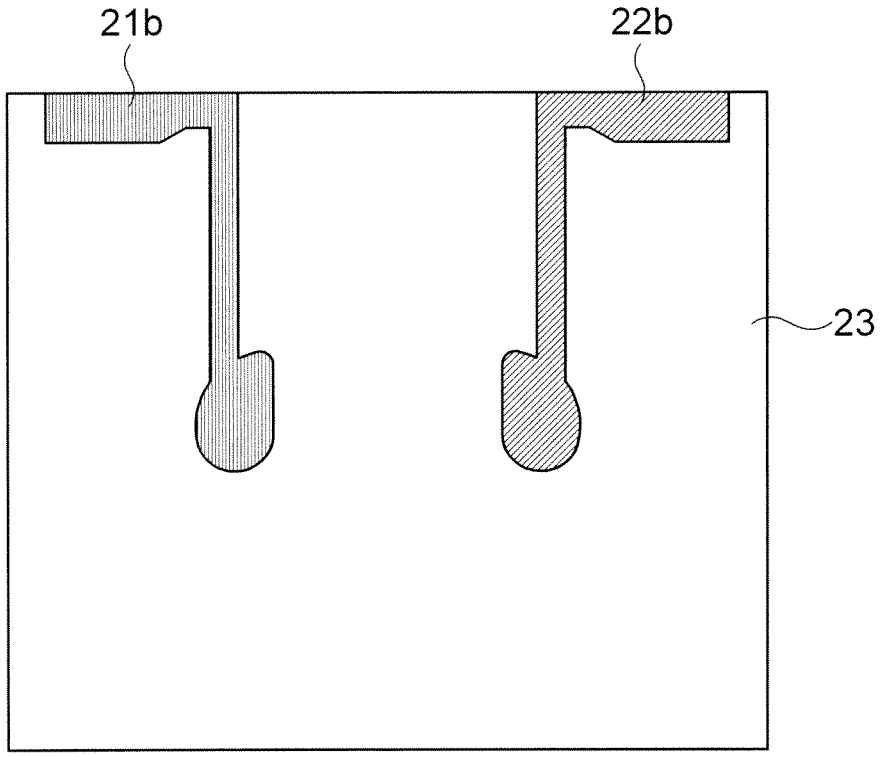
FIG. 2*c* is a plan view schematically showing an output-side lead pattern of the primary coil pattern of FIG. 2*a* and an output-side lead pattern of the secondary coil pattern of FIG. 2*b;*

Advantages and features of the present invention and methods of accomplishing the same will be apparent by referring to embodiments described below in detail in connection with the accompanying drawings. However, the present invention is not limited to the embodiments disclosed below and may be implemented in various different forms. The exemplary embodiments are provided only for completing the disclosure of the present invention and for fully representing the scope of the present invention to those skilled in the art. Like reference numerals refer to like elements throughout the specification.

Terms used herein are provided to explain embodiments, not limiting the present invention. Throughout this specification, the singular form includes the plural form unless the context clearly indicates otherwise. When terms "comprises" and/or "comprising" used herein do not preclude existence and addition of another component, step, operation and/or device, in addition to the above-mentioned component, step, operation and/or device.

Further, embodiments to be described throughout the specification will be described with reference to cross-sectional views and/or plan views, which are ideal exemplary drawings of the present invention. In the drawings, the thicknesses of layers and regions may be exaggerated for the effective explanation of technical contents. Therefore, the exemplary drawings may be modified by manufacturing techniques and/or tolerances. Therefore, the embodiments of the present invention are not limited to the accompanying drawings, and can include modifications to be generated according to manufacturing processes. For example, an etched region shown at a right angle may be formed in the rounded shape or formed to have a predetermined curvature. Therefore, regions shown in the drawings have schematic characteristics. In addition, the shapes of the regions shown in the drawings exemplify specific shapes of regions in an element, and do not limit the invention.

Hereinafter, an embodiment of a conductor pattern and coil parts having the same in accordance with the present invention will be described in detail with reference to FIGS. 3 to 5*f*.

Figure 3:
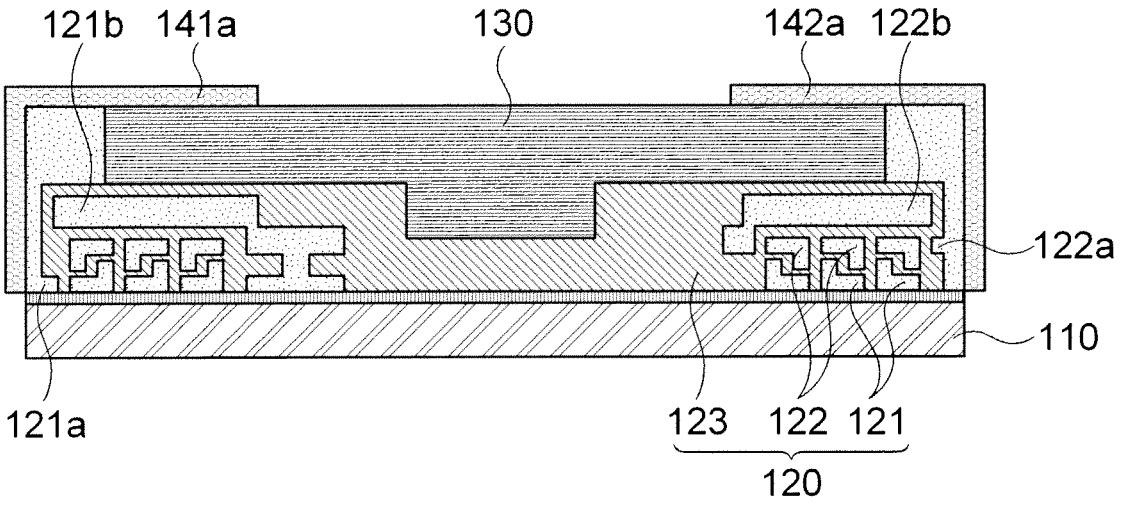
FIG. 3 is a cross-sectional view schematically showing an embodiment of a coil part including a conductor pattern in accordance with the present invention.
Figure 4A:
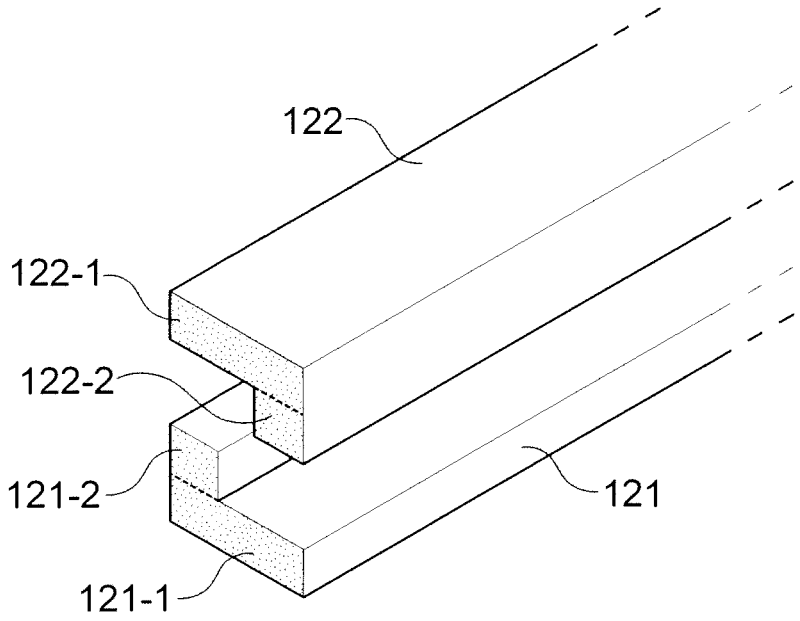
FIG. 4*a* is a principal perspective view schematically showing a portion of the conductor pattern of FIG. 3.
Figure 4B:
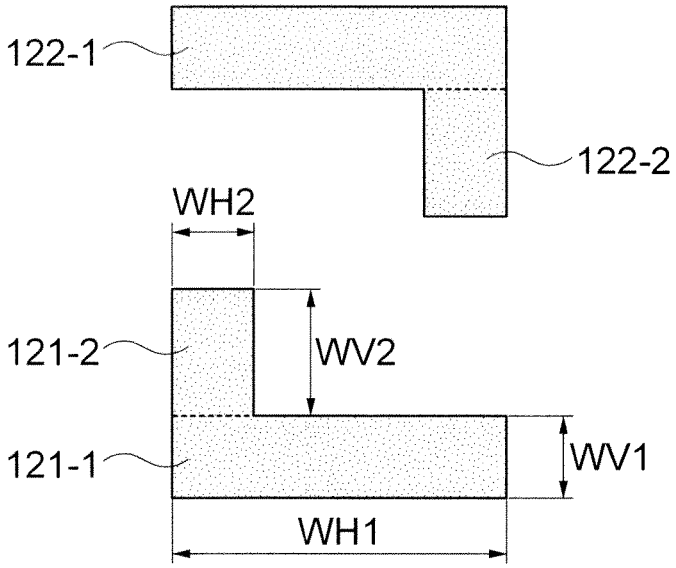
FIG. 4*b* is a cross-sectional view schematically showing a longitudinal section of the conductor pattern of FIG. 3.

FIG. 3 is a cross-sectional view schematically showing an embodiment of a coil part including a conductor pattern in accordance with the present invention, FIG. 4*a* is a principal perspective view schematically showing a portion of the conductor pattern of FIG. 3, and FIG. 4*b* is a cross-sectional view schematically showing a longitudinal section of the conductor pattern of FIG. 3.

Figure 5A:
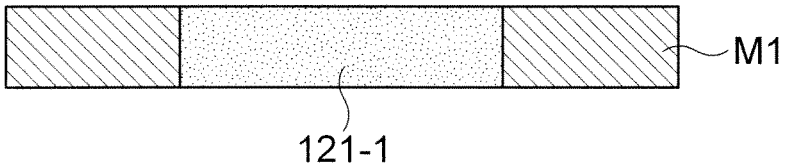
Figure 5B:
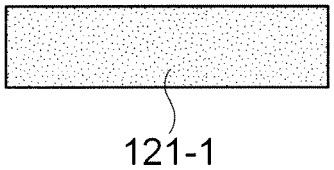
Figure 5C:
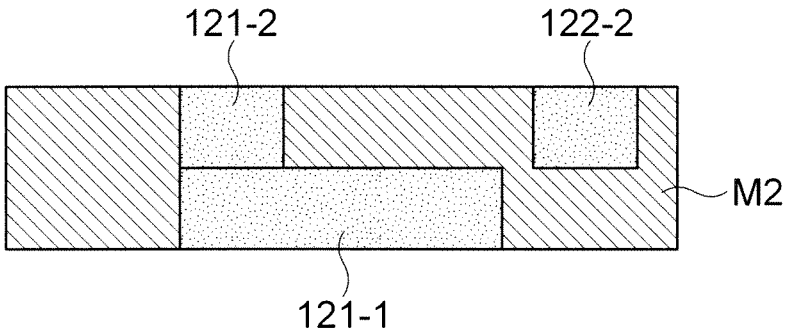
Figure 5D:
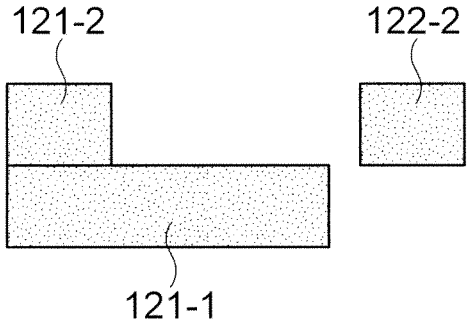
Figure 5E:
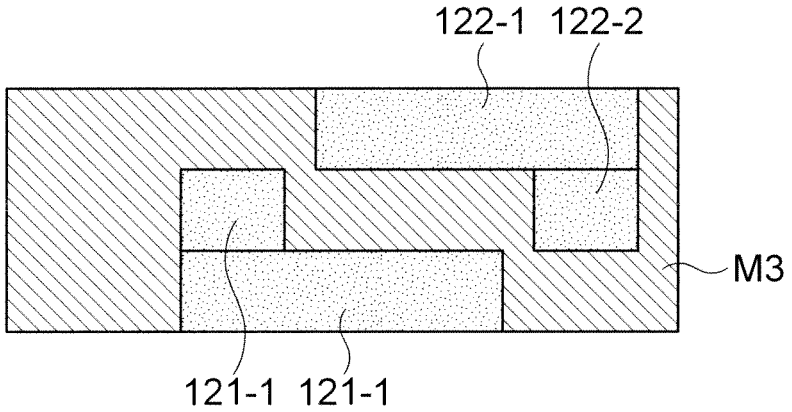
Figure 5F:
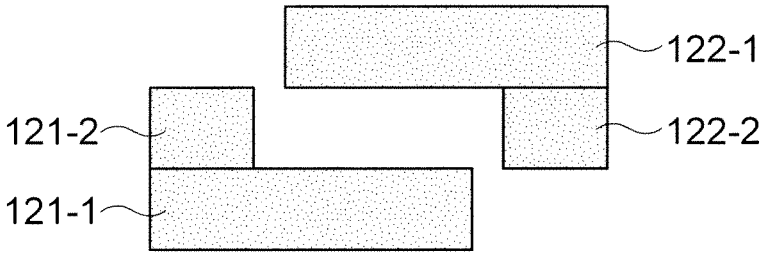

And, FIGS. 5*a* to 5*f* are process diagrams for explaining a process of manufacturing the conductor pattern in accordance with the present invention, wherein FIG. 5*a* is a cross-sectional view schematically showing a state in which a first horizontal portion of a primary conductor pattern is plated through a first mask by primary photo and exposure processes, FIG. 5*b* is a cross-sectional view schematically showing a state in which the first mask of FIG. 5*a* is removed, FIG. 5*c* is a cross-sectional view schematically showing a state in which a first vertical portion and a second vertical portion of a secondary conductor pattern are plated through a second mask by secondary photo and exposure processes, FIG. 5*d* is a cross-sectional view schematically showing a state in which the second mask of FIG. 5*c* is removed, FIG. 5*e* is a cross-sectional view schematically showing a state in which a second horizontal portion is plated through a third mask by tertiary photo and exposure processes, and FIG. 5*f* is a cross-sectional view schematically showing a state in which the conductor pattern including the primary conductor pattern and the secondary conductor pattern is formed by removing the third mask of FIG. 5*e*.

Referring to FIGS. 3 to 4*b*, as an example of a coil part in accordance with the present invention, an embodiment of a coil part including a conductor pattern in accordance with the present invention may include a magnetic substrate 110, a coil layer 120 disposed on the magnetic substrate 110 and including a conductor pattern in accordance with the present invention, and an upper magnetic body 130 disposed on the coil layer 120.

The magnetic substrate 110 may consist of a magnetic substance in the form of a substrate including a ferrite magnetic material.

The coil layer 120 may include a primary conductor pattern 121 formed in a spiral shape on the magnetic substrate 110, a secondary conductor pattern 122 formed in a spiral shape on the primary conductor pattern 121 to correspond to the primary conductor pattern 121, and an insulating layer 123 for electrically isolating the primary conductor pattern 121 and the secondary conductor pattern 122 from each other.

At this time, a first input lead pattern 121*a* and a first output lead pattern 121*b* for inputting and outputting electricity to and from the primary conductor pattern 121 may be formed on the insulating layer 123, and a second input lead pattern 122*a* and a second output lead pattern 122*b* for inputting and outputting electricity to and from the secondary conductor pattern 122 may be formed on the insulating layer 123.

Further, an output terminal of the primary conductor pattern 121 and an output terminal of the secondary conductor pattern 122 may be electrically connected to the first output lead pattern 121*b* and the second output lead pattern 122*b* through via connection structures, respectively.

In the coil part of this embodiment, the primary conductor pattern 121 may be formed in a planar spiral shape and formed to have a longitudinal section including a first horizontal portion 121-1 and a first vertical portion 121-2 electrically connected to an end portion of one surface of the first horizontal portion 121-1.

And, the secondary conductor pattern 122 also may be formed in a planar spiral shape and formed to have a longitudinal section including a second horizontal portion 122-1 corresponding to the first horizontal portion 121-1 and a second vertical portion 122-2 electrically connected to an end portion of one surface of the second horizontal portion 122-1, which faces one surface of the first horizontal portion 121-1.

That is, the first vertical portion 121-2 may be formed in an inner end portion of an upper surface of the first horizontal portion 121-1, and the second vertical portion 122-2 may be formed in an outer end portion of a lower surface of the second horizontal portion 122-1.

Here, a horizontal width WH1 of the first horizontal portion 121-1 may be 10 to 15 μm, a vertical width WV1 of the first horizontal portion 121-1 may be 3 to 5 μm, a horizontal width WH2 of the first vertical portion 121-2 may be 3 to 5 μm, and a vertical width WV2 of the first vertical portion 121-2 may be 12 to 15 μm.

Of course, the second horizontal portion 122-1 and the second vertical portion 122-2 may be formed with the same size as the first horizontal portion 121-1 and the first vertical portion 121-2.

That is, a horizontal width of the second horizontal portion 122-1 may be 10 to 15 μm, a vertical width of the second horizontal portion 122-1 may be 3 to 5 μm, a horizontal width of the second vertical portion 122-2 may be 3 to 5 μm, and a vertical width of the second vertical portion 122-2 may be 12 to 15 μm.

Meanwhile, the first input lead pattern 121*a* may be connected to a first external input terminal 141*a*, the first output lead pattern 121*b* may be connected to a first external output terminal (not shown) corresponding to the first external input terminal 141*a*, the second input lead pattern 122*a* may be connected to a second external input terminal 142*a*, and the second output lead pattern 122*b* may be connected to a second external output terminal (not shown) corresponding to the second external input terminal 142*a*.

The conductor pattern and the coil parts having the same in accordance with this embodiment can increase a cross section while maintaining substantially the same size in a longitudinal, that is, horizontal (left and right) direction of an existing coil pattern by configuring the primary conductor pattern 121 including the first horizontal portion 121-1 and the first vertical portion 121-2 and the secondary conductor pattern 122 including the second horizontal portion 122-1 and the second vertical portion 122-2, thus making it possible to increase performance and capacity of the product while minimizing or preventing an increase in the size of the product.

Further, the conductor pattern and the coil parts having the same in accordance with this embodiment can minimize an increase in the vertical, that is, up and down size of the product due to an increase in the cross section of the primary conductor pattern 121 and the secondary conductor pattern 122 by forming the first vertical portion 121-2 of the primary conductor pattern 121 and the second vertical portion 122-2 of the secondary conductor pattern 122 on the same horizontal layer of the insulating layer 123 at the same time.

In more detail, a process of manufacturing the primary conductor pattern 121 and the secondary conductor pattern 122 of this embodiment will be described with reference to FIGS. 5*a* to 5*f*.

First, as shown in FIG. 5*a*, after coating the insulating layer on an upper surface of the magnetic substrate, the first horizontal portion 121-1 of the primary conductor pattern 121 is formed by performing primary photo and exposure processes using a first mask M1 and plating a conductive material such as Cu.

And, as shown in FIG. 5*b*, the first horizontal portion 121-1 is completed through a primary removal process such as a process of removing/etching photoresist like the first mask.

Next, as shown in FIG. 5*c*, the first vertical portion 121-2 of the primary conductor pattern 121 and the second vertical portion 122-2 of the secondary conductor pattern 122 are formed at the same time by performing secondary photo and exposure processes using a second mask M2 and plating a conductive material.

And, as shown in FIG. 5*d*, the first vertical portion 121-2 and the second vertical portion 122-2 are completed at the same time through a secondary removal process such as a process of removing/etching photoresist like the second mask.

Next, as shown in FIG. 5*e*, the second horizontal portion 122-1 of the secondary conductor pattern 122 is formed by performing tertiary photo and exposure processes using a second mask M3 and plating a conductive material.

Finally, as shown in FIG. 5*f*, the primary conductor pattern 121 and the secondary conductor pattern 122 in accordance with this embodiment are completed by completing the second horizontal portion 122-1 through a tertiary removal process such as a process of removing/etching photoresist like the third mask.

As described above, the conductor pattern and the coil parts having the same can form the first vertical portion 121-2 of the primary conductor pattern 121 and the second vertical portion 122-2 of the secondary conductor pattern 122 on the same horizontal layer at the same time.

That is, it is possible to form the first vertical portion 121-2 of the primary conductor pattern 121 and the second vertical portion 122-2 of the secondary conductor pattern 122 in a space on the insulating layer for insulating between the existing primary coil pattern and secondary coil pattern at the same time. Accordingly, it is possible to minimize or prevent an increase in the vertical, that is, up and down size of the product while minimizing an increase in the horizontal, that is, left and right size of the coil part when the performance and capacity of the coil part is improved due to an increase in the cross section of the primary coil pattern 121 and the secondary coil pattern 122.

As described above, according to the conductor pattern and the coil parts having the same in accordance with the present invention, it is possible to achieve miniaturization by improving the structure of the conductor pattern to reduce the horizontal size of the coil part compared to the same size of the conductor pattern.

And, according to the conductor pattern and the coil parts having the same in accordance with the present invention, it is possible to implement high performance and characteristics by increasing the cross section of the conductor pattern compared to the same size of the conductor pattern to thereby obtain high inductance.

The foregoing description illustrates the present invention. Additionally, the foregoing description shows and explains only the preferred embodiments of the present invention, but it is to be understood that the present invention is capable of use in various other combinations, modifications, and environments and is capable of changes and modifications within the scope of the inventive concept as expressed herein, commensurate with the above teachings and/or the skill or knowledge of the related art. The embodiments described hereinabove are further intended to explain best modes known of practicing the invention and to enable others skilled in the art to utilize the invention in such, or other, embodiments and with the various modifications required by the particular applications or uses of the invention. Accordingly, the description is not intended to limit the invention to the form disclosed herein. Also, it is intended that the appended claims be construed to include alternative embodiments.

What is claimed is:

1. A conductor pattern of a common-mode filter comprising a magnetic substrate, a coil layer on the magnetic substrate, and a top magnetic material formed an a top of the coil layer, wherein the common-mode filter is electrically isolated by being covered with an insulating layer of the coil layer, the conductor pattern comprising:

a primary conductor pattern having both a first horizontal portion and a first vertical portion, which is vertically connected to the first horizontal portion; and a secondary conductor pattern having both a second horizontal portion and a second vertical portion, which is vertically connected to the second horizontal portion, wherein the primary conductor pattern and the secondary conductor pattern are arranged to face opposedly to one another, wherein the secondary conductor pattern is formed on the primary conductor pattern to correspond to the primary conductor pattern, wherein a horizontal width of the first horizontal portion is 10 to 15 μm, a vertical width of the first horizontal portion is 3 to 5 μm, a horizontal width of the first vertical portion is 3 to 5 μm, and a vertical width of the first vertical portion is 12 to 15 μm, and the second horizontal portion and the second vertical portion are formed with the same size as the first horizontal portion and the first vertical portion.

2. The conductor pattern according to claim 1, wherein the first vertical portion is formed in an inner end portion of an upper surface of the first horizontal portion, and the second vertical portion is formed in an outer end portion of a lower surface of the second horizontal portion.

3. A common-mode filter, comprising:

a magnetic substrate;

a coil layer on the magnetic substrate; and a top magnetic material formed an a top of the coil layer, wherein the common-mode filter is electrically isolated by being covered with an insulating layer of the coil layer, wherein the coil layer comprises:

a primary conductor pattern having both a first horizontal portion and a first vertical portion which is vertically connected to the first horizontal portion; and a secondary conductor pattern having both a second horizontal portion and a second vertical portion which is vertically connected to the second horizontal portion, wherein the primary conductor pattern and the second pattern are formed in a spiral shape respectively and are arranged to face opposedly to one another, and wherein the secondary conductor pattern is formed on the primary conductor pattern to correspond to the primary conductor pattern, wherein a horizontal width of the first horizontal portion is 10 to 15 a vertical width of the first horizontal portion is 3 to 5 μm, a horizontal width of the first vertical portion is 3 to 5 μm, and a vertical width of the first vertical portion is 12 to 15 μm, and the second horizontal portion and the second vertical portion are formed with the same size as the first horizontal portion and the first vertical portion.

4. The common-mode filter according to claim 3, wherein the first vertical portion is formed in an inner end portion of an upper surface of the first horizontal portion, and the second vertical portion is formed in an outer end portion of a lower surface of the second horizontal portion.

* * * * *